US006238058B1

(12) United States Patent
Lin

(10) Patent No.: US 6,238,058 B1
(45) Date of Patent: May 29, 2001

(54) MEANS FOR ADJUSTING THE ILLUMINATING ANGLE OF LIGHTING DEVICE OF SOCKET WRENCH

(76) Inventor: Chang-Ming Lin, No. 331, Chang Chun St., Chiu Te Village, Wu Jih Hsiang, Taichung County (TW)

( * ) Notice: Subject to any disclaimer, the term of this patent is extended or adjusted under 35 U.S.C. 154(b) by 0 days.

(21) Appl. No.: 09/528,852

(22) Filed: Mar. 20, 2000

(51) Int. Cl.[7] ..... B25B 23/18
(52) U.S. Cl. ..... 362/119; 362/120
(58) Field of Search ..... 362/119, 120, 362/109

(56) References Cited

U.S. PATENT DOCUMENTS 4,324,158 * 4/1982 Le Roy ..... 81/60
5,848,832 * 12/1998 Hsieh ..... 362/119
5,899,554 * 4/1999 Hsu ..... 362/119
6,186,638 * 2/2001 Chang ..... 362/119

* cited by examiner

*Primary Examiner*—Sandra O'Shea
*Assistant Examiner*—Ronald E. DelGizzi
(74) *Attorney, Agent, or Firm*—Harrison & Egbert

(57) ABSTRACT

A socket wrench including a socket, a handle, and a handle body in which an illuminating element is disposed. The handle is provided with a threaded hole and a threaded rod which is engaged with the threaded hole. The illuminating element has an extension guide body with is put through a swiveling tube capable of being actuated by the threaded rod to adjust the illuminating angle of the illuminating element in relation to the position level of the socket of the socket wrench.

1 Claim, 4 Drawing Sheets

MEANS FOR ADJUSTING THE ILLUMINATING ANGLE OF LIGHTING DEVICE OF SOCKET WRENCH

FIELD OF THE INVENTION

The present invention relates generally to a lighting device of the socket wrench, and more particularly to a structure designed for adjusting the illuminating angle of the lighting device of the socket wrench.

BACKGROUND

The socket wrench is an ubiquitous hand tool; it is a very useful hand tool that is commonly used in the work shop, factory, school, and private home. The conventional socket wrench is provided with a lighting device to facilitate the operating of the socket wrench in a dark or poorly-lit place. The lighting device of the conventional socket wrench is defective in design because the lighting device is not provided with a means to adjust the angle at which the lighting device illuminates, thereby undermining the maneuverability of the socket wrench in the dark or poor-lit work place.

SUMMARY OF THE INVENTION

It is therefore the primary objective of the present invention to provide a socket wrench with a lighting device which is free from the shortcoming of the lighting device of the socket wrench of the prior art.

In keeping with the principle of the present invention, the foregoing objective of the present invention is attained by a socket wrench comprising a socket, a handle, and a handle body in which an illuminating element is disposed. The handle is provided with a threaded hole and a threaded rod which is engaged with the threaded hole. The illuminating element has an extension guide body which is put through a swiveling tube capable of being actuated by the threaded rod to adjust the illuminating angle of the illuminating element in relation to the position level of the socket of the socket wrench.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
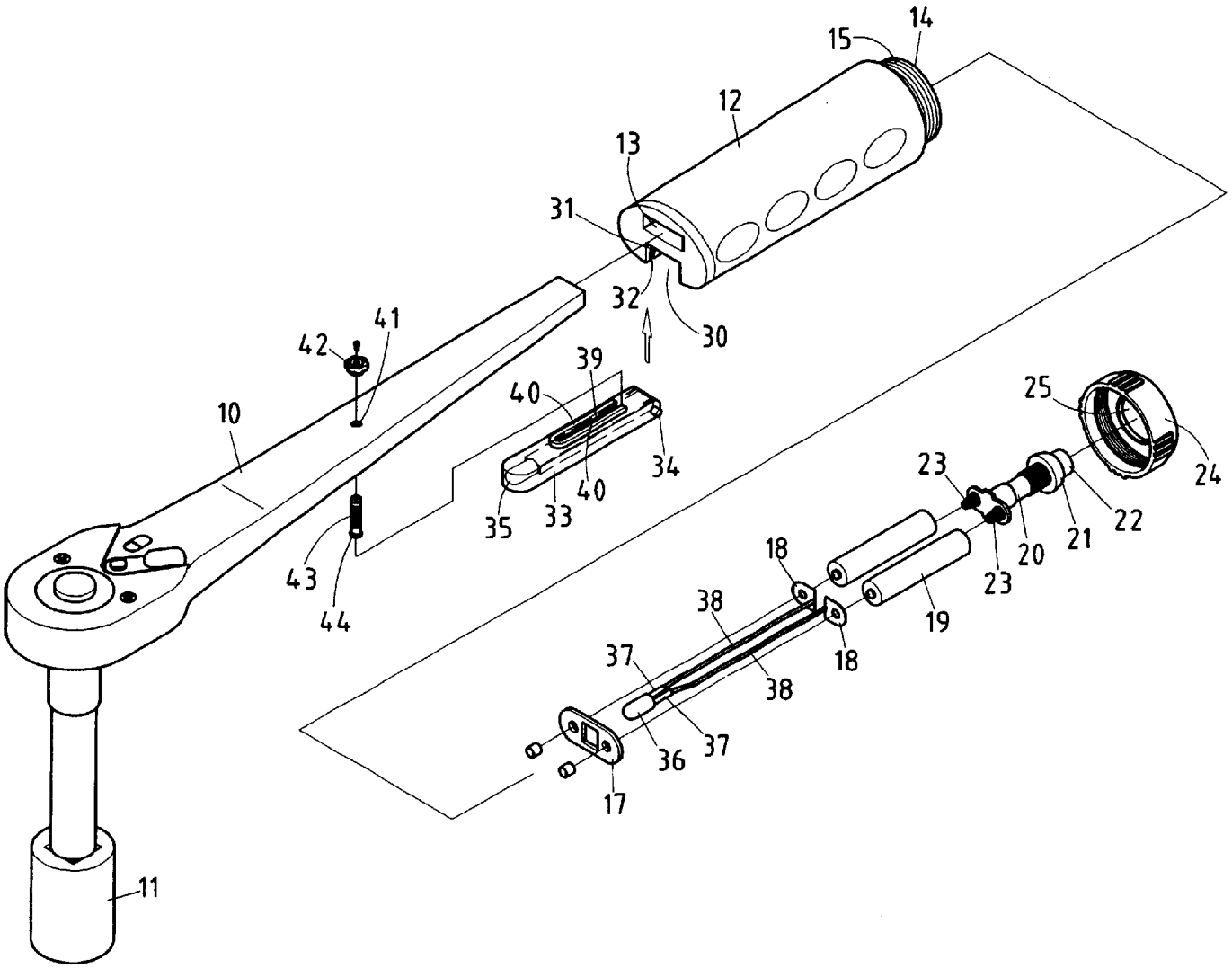
FIG. 1 shows an exploded view of the preferred embodiment of the present invention.
Figure 2:
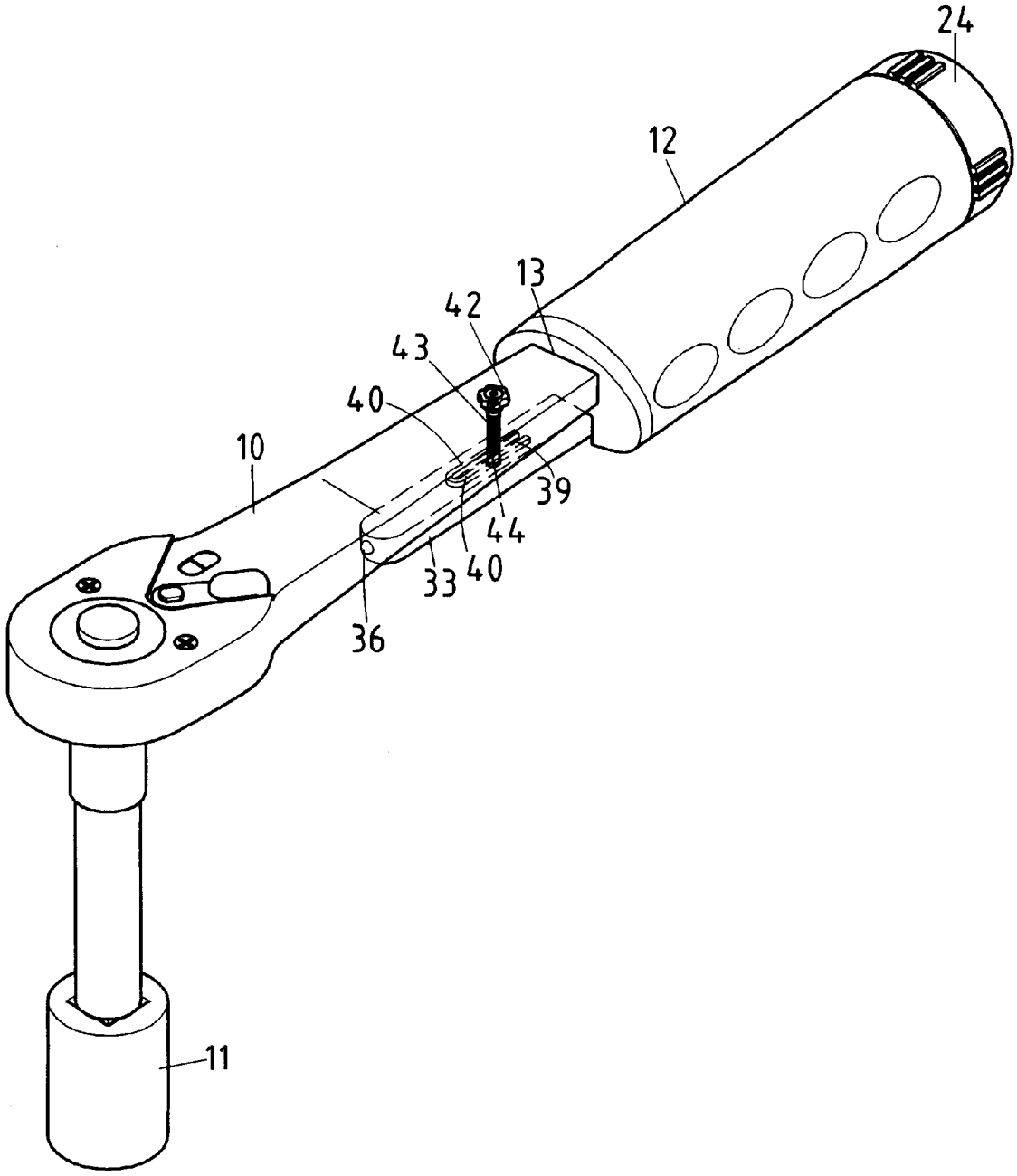
FIG. 2 shows a perspective view of the preferred embodiment of the present invention.

As shown in FIGS. 1–4, a socket wrench embodied in the present invention comprises a handle 10, a socket 11, and a handle body 12 which is provided at one end thereof with a fastening hole 13 for fastening the free end of the handle 10.

The handle body 12 is provided at the other end thereof with a plug opening 14 having a threaded portion 15 and a shoulder 16. The plug opening 14 is provided therein with an insulated plug body 17 having a conductive piece 18, a battery set 19, and a switching element 20 having a shoulder 21, a press button 22 and a contact spring 23. The plug opening 14 is sealed off by a cap 24 having a receiving hole 25.

Figure 3:
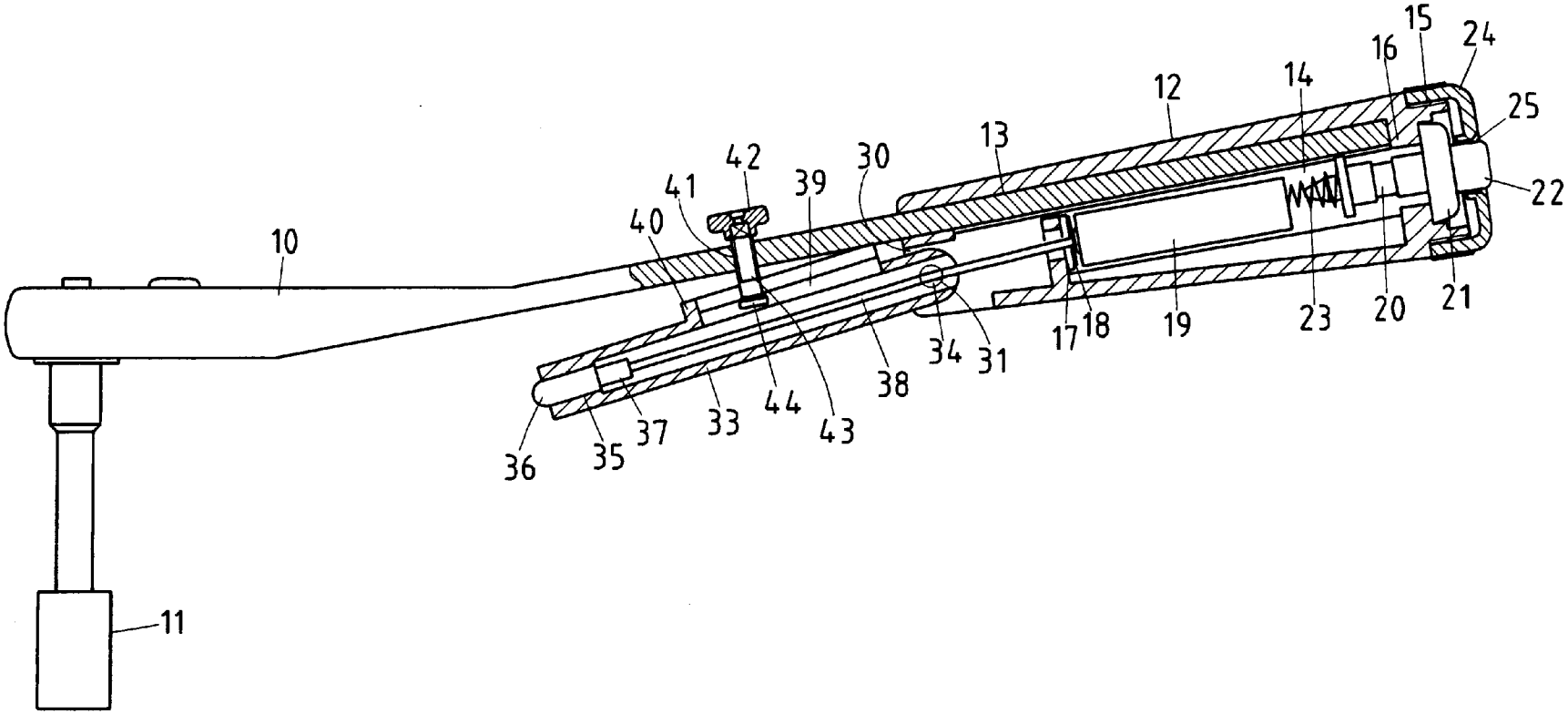
FIG. 3 shows a sectional view of the preferred embodiment of the present invention.
Figure 4:
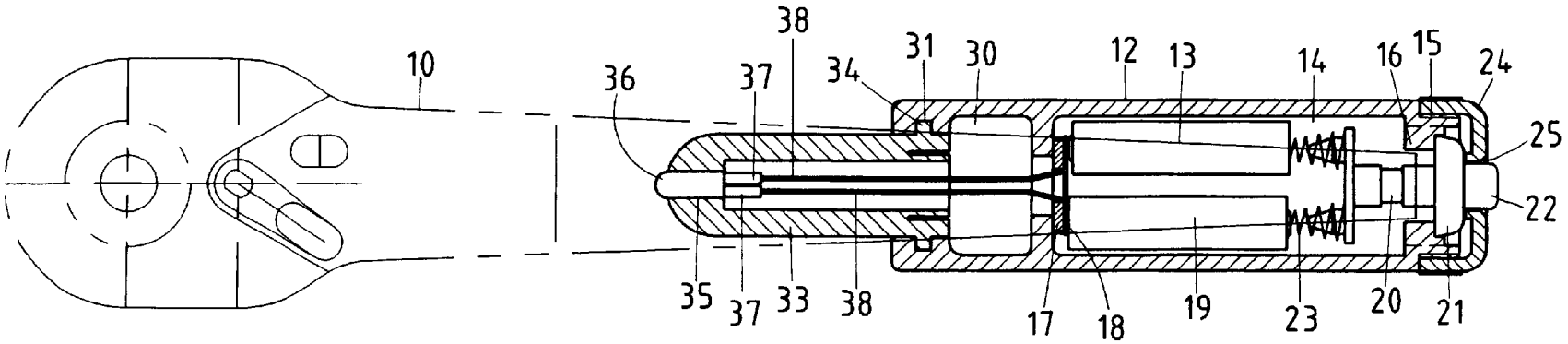
FIG. 4 shows another sectional view of the preferred embodiment of the present invention.

As shown in FIGS. 3 and 4, the handle body 12 is provided at one end thereof with a clamping cell 30 having two pivoting slots 31 and communicating with the plug opening 14. The pivoting slot 31 is provided with a guide slot 32 extending to the opening edge of the clamping cell 30. A swiveling tube 33 is provided with two shaft rods 34 and is pivoted in the pivoting slots 31 of the clamping cell 30. The swiveling tube 33 has a light bulb opening 35 in which an illuminating element 36 is disposed such that two pins of the illuminating element 36 are connected with two extension guide bodies 38. The swiveling tube 33 is provided with two parallel ribs 39 between which a support slot 40 is formed. The handle 10 is provided with a threaded hole 41 and a threaded rod 43 which is engaged with the threaded hole 41 and is provided with a revolving portion 42. The threaded rod 43 has a head 44 which is slidably received in the support slot 40. The swiveling tube 33 is actuated by the threaded rod 43 to adjust the illuminating angle of the illuminating element 36 in relation to the position level of the socket 11.

What is claimed is:

1. A socket wrench comprising a handle, a socket, and a handle body which is provided at one end thereof with a fastening hole for fastening the free end of said handle, and at other end thereof with a plug opening which is provided with a threaded portion and a shoulder, said plug opening further provided therein with an insulated plug body having a conductive piece, a battery set, and a switching element having a shoulder, a press button and a contact spring; wherein said handle body is provided at one end thereof with a clamping cell having two pivoting slots and communicating with said plug opening, said pivoting slots being provided with a guide slot extending to an opening edge of said clamping cell, said pivoting slots further provided with a swiveling tube pivoted therewith, said swiveling tube having a light bulb opening in which an illuminating element is disposed such that two pins of said illuminating element are connected with two extension guide bodies, said swiveling tube further provided with two parallel ribs between which a support slot is formed; wherein said handle is provided with a threaded hole and a threaded rod engaged with said threaded hole, said threaded rod having a head which is slidably received in said support slot whereby said swiveling tube is actuated by said threaded rod to adjust an illuminating angle of said illuminating element in relation to a position level of said socket.

* * * * *